US008002595B2

(12) United States Patent
Kobayashi

(10) Patent No.: US 8,002,595 B2
(45) Date of Patent: Aug. 23, 2011

(54) ELECTRICAL CONTACT MATERIAL, METHOD OF MANUFACTURING THE SAME, AND ELECTRICAL CONTACT

(75) Inventor: Yoshiaki Kobayashi, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 9 days.

(21) Appl. No.: 12/522,319

(22) PCT Filed: Jan. 11, 2008

(86) PCT No.: PCT/JP2008/050291

§ 371 (c)(1),
(2), (4) Date: Oct. 29, 2009

(87) PCT Pub. No.: WO2008/084858

PCT Pub. Date: Jul. 17, 2008

(65) Prior Publication Data

US 2010/0062663 A1 Mar. 11, 2010

(30) Foreign Application Priority Data

Jan. 12, 2007 (JP) ..... 2007-005203
Jan. 10, 2008 (JP) ..... 2008-003755

(51) Int. Cl.
*H01R 13/02* (2006.01)

(52) U.S. Cl. ..... 439/886; 439/931

(58) Field of Classification Search ..... 439/886, 439/887, 931

See application file for complete search history.

(56) References Cited

U.S. PATENT DOCUMENTS 6,143,700 A * 11/2000 Kato ..... 508/268

FOREIGN PATENT DOCUMENTS

| | | | |
|---|---|---|---|
| JP | 60-251285 | A | 12/1985 |
| JP | 60-254522 | A | 12/1985 |
| JP | 03-188283 | A | 8/1991 |
| JP | 06-162859 | A | 6/1994 |
| JP | 06-212491 | A | 8/1994 |
| JP | 07-073768 | A | 3/1995 |
| JP | 08-109342 | A | 4/1996 |
| JP | 08-260193 | A | 10/1996 |
| JP | 11-217579 | A | 8/1999 |
| JP | 2003-328153 | A | 11/2003 |

OTHER PUBLICATIONS

Japan Patent Office, Office Action for Application 2008-003755, Oct. 28, 2008.

Japan Patent Office, Office Action for Application 2008-324224, Feb. 3, 2009.

* cited by examiner

*Primary Examiner* — Ross N Gushi

(74) *Attorney, Agent, or Firm* — Kubotera & Associates LLC

(57) ABSTRACT

An electrical contact material includes a surface layer formed of a noble metal or an alloy containing the noble metal as a major constituent. An organic film having heat resistance is formed on a surface of the surface layer, and the organic film is formed of an organic compound having an ether bonding group. Accordingly, the electrical contact material has good corrosion resistance and sliding resistance.

7 Claims, 1 Drawing Sheet

ELECTRICAL CONTACT MATERIAL, METHOD OF MANUFACTURING THE SAME, AND ELECTRICAL CONTACT

TECHNICAL FIELD

The present invention relates to an electrical contact material. The present invention also relates to a method of manufacturing an electrical contact material, and an electrical contact manufactured with the method.

BACKGROUND TECHNOLOGY

In the past, copper or a copper alloy having good electrical conductivity has been used for electrical contact components. As characteristics of contacts have improved recently, pure copper or a copper alloy has been seldom used. Alternatively, products have been developed in which various surface processing is performed on copper or copper alloy. In particular, a noble metal is coated onto an electrical contact region as a material largely utilized for an electrical contact. Among those, noble metals such as Au, $A_g$, Pd, Pt, Ir, Rh, and Ru have stable property and good electrical conductivity, and are utilized as various electrical contact materials. Especially, $A_g$ exhibits excellent conductivity, and is wildly used in various applications due to a relatively low price.

Recently, an electrical contact material having a good abrasion resistance is used for electrical contacts such as connector terminals and sliding switches for automobile harnesses, contact switches mounted on mobile phones, or terminals for memory cards and PC cards, in which insertion and extraction is repeatedly conducted or a sliding operation is performed. In order to improve the abrasion resistance, contact materials that use hard Ag or hard Au are generally used. In particular, since Ag is less expensive than Au, Pd, etc., a hard gloss Ag plating material has been developed in recent years to use in places where the abrasion resistance is required. Furthermore, a plating and cladding material have been developed, in which micro-particles are dispersed, and various surface processing materials are developed for improving sliding property of a material for an electrical contact.

In order to improve the sliding property, a sealing process or a lubrication process is performed on a surface of a material after plating. For example, after pure Ag plating is applied onto an Ag alloy, an organic film comprised of an aliphatic amine, a mercaptan, or a mixture thereof is provided, thereby improving sulfur resistance and abrasion resistance (refer to Japanese patent publication No. JP 06-212491).

DISCLOSURE OF THE INVENTION

In the conventional material for an electrical contact treated with the hard Ag or hard Ag plating processing, the abrasion property is improved as compared to a glossless Ag material. However, when the conventional material is used in a place where a relatively high load sliding is required, the conventional material tends to wear in a short period of time. Accordingly, a base material is easily exposed to cause oxidation and corrosion, thereby causing poor electrical conductivity of the sliding contact material. When a thickness of a noble metal increases to prevent a base material from being exposed, a cost of the material increases due to a large amount of noble metal. In the conventional method of providing the organic film comprised of an aliphatic amine, a mercaptan, or a mixture thereof, it is possible to improve abrasion resistance at a relatively low load less than equal to 0.5 N. However, when a load becomes 0.5 N or more, abrasion tends to proceed at an accelerated rate. When a load becomes 1 N to 1.5 N, sliding resistance worsens quickly. Further, a pure Ag layer is disposed on an Ag alloy to form a double layer structure, thereby increasing a manufacturing cost.

Furthermore, the electrical contact material sometimes shows a decrease in a sliding property under a high temperature environment, and this is caused by insufficient heat resistance of the organic film.

In order to resolve the above-described problems, an object of the present invention is to provide an electrical contact material that has a good sliding property, good heat resistance, and corrosion resistance through abrasion resistance against a relatively high load about 1N or above. Moreover, an object of the present invention is to provide a method of manufacturing an electrical contact material having such characteristics, and an electrical contact formed of the electrical contact material.

As a result of examination to solve the above-described problems, it is found that an electrical contact material having a surface layer comprised of a noble metal or an alloy containing the noble metal as a major constituent exhibits good abrasion resistance and sliding resistance. The electrical contact material includes an organic film having heat resistance on a surface of the surface layer, and the organic film is formed of an organic compound having an ether bonding group. The present invention was achieved with the knowledge. The present invention provides the following:

(1) An electrical contact material includes a surface layer formed of a noble metal or an alloy containing the noble metal as a major constituent. An organic film having heat resistance is formed on a surface of the surface layer, and the organic film is formed of an organic compound having an ether bonding group. Accordingly, the electrical contact material has good corrosion resistance and sliding resistance.

(2) An electrical contact material includes a surface layer formed of a noble metal or an alloy containing the noble metal as a major constituent. A first organic film layer formed of an aliphatic amine, a mercaptan, or a mixture thereof is formed on a surface of the surface layer. A second organic film having heat resistance is provided on a surface of the first organic film layer, and the second organic film is formed of an organic compound having an ether bonding group. Accordingly, the electrical contact material has good corrosion resistance and sliding property.

(3) In the electrical contact material according to (2), the noble metal forming the surface layer includes one of Au, Ag, Cu, Pt, Pd, or an alloy containing the same as the major constituent.

(4) In the electrical contact material according to (2), the noble metal forming the surface layer includes Ag or an alloy containing Ag as the major constituent.

(5) In a method of manufacturing the electrical contact material according to one of (1)-(4), the surface layer formed of the noble metal or the alloy containing the noble metal as the major constituent is formed with a plating method or a cladding method.

(6) An electrical contact includes the electrical contact material according to one of (1)-(4).

The above and other objects, features and advantages of the present invention will be better understood by reading the following detailed description of the best mode of the invention, when considered in connection with the accompanying drawings.

DETAILED DESCRIPTION OF THE BEST MODE OF THE INVENTION

In the following, an electrical contact material according to the present invention will be described.

In the specification and the claims, "noble metal" indicates a metal whose ionization tendency is smaller than hydrogen and which is noble.

In the specification and the claims, "electrical contact material having a surface layer comprised of a noble metal or an alloy that has a noble metal as a major constituent" indicates an electrical contact material in which a noble metal or an alloy that has a noble metal as a major constituent appears in an outermost surface before formation of an organic film.

A shape of the electrical material according to the present invention is not limited as far as it is used as an electrical contact material, and may includes a plate, a stick, a wire, a tube, a strip, and an atypical strip shape. Furthermore, a surface needs not to be covered completely with a noble metal or its alloy, and may be partially exposed in areas where it is used as a contact material, such as a stripe shape of a hoop strip and a spot shape.

In the specifications and the claims, "an alloy that contains a noble metal as a major constituent" indicates an alloy that has 50 mass % or more of a noble metal, and an alloy that contains 70 mass % or more is preferable.

As for the electrical contact material according to the present invention, there is no limitation to a composition of a noble metal or an alloy that has a noble metal as a major constituent, and specific examples of gold (Au) or Au alloy include Au, Au—Ag alloy, Au—Cu alloy, Au—Ni alloy, Au—Co alloy, Au—Pd alloy, and Au—Fe alloy, specific examples for silver (Ag) or Ag alloy include Ag, Ag—Cu alloy, Ag—Ni alloy, Ag—Se alloy, Ag—Sb alloy, Ag—Sn alloy, Ag—Cd alloy, Ag—Fe alloy, Ag—In alloy, Ag—Zn alloy, Ag—Li alloy, Ag—Co alloy, and Ag—Pb alloy. Specific examples of Cu or Cu alloy include Cu, Cu—Sn alloy, Cu—Zn alloy, Cu—Ag alloy, Cu—Au alloy, Cu—Ni alloy, and Cu—Fe alloy.

Figure 1:
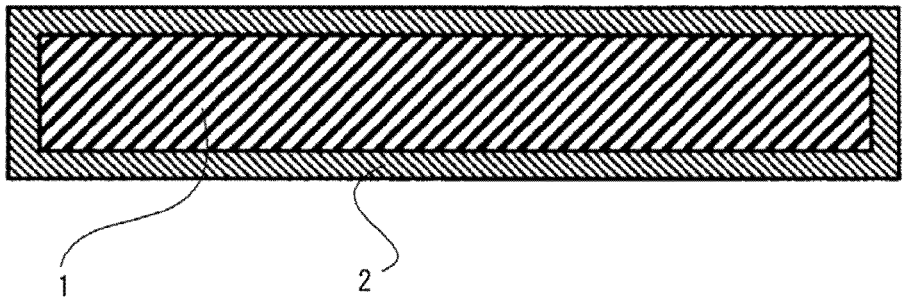
FIG. 1 is a cross sectional view of an electrical contact material according to an embodiment of the present invention.

FIG. 1 shows a cross sectional view of an electrical contact material according to an embodiment of the present invention.

In FIG. 1, there is provided with an organic film 2 having heat resistance formed with an organic compound having an ether bonding group, on the surface of a noble metal or its alloy 1.

Figure 2:
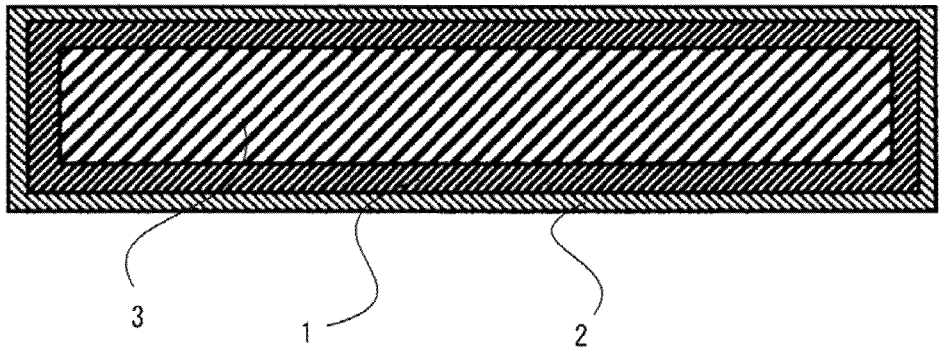
FIG. 2 is a cross sectional view of an electrical contact material according to another embodiment of the present invention.

FIG. 2 shows a cross sectional view of an electrical contact material according to another embodiment of the present invention.

In FIG. 2, a surface layer comprised of a noble metal or its alloy 1 is formed on a surface of a base material 3, and there is provided with an organic film 2 having heat resistance, formed with an organic compound having an ether bonding group on a surface of the surface layer.

In the present invention, there is no limitation to the base material in which the surface layer comprising a noble metal or an alloy that has a noble metal as a major constituent is formed, as long as it is used as a base material for an electrical contact material, and examples include copper (Cu) or its alloy, iron (Fe) or its alloy, nickel (Ni) or its alloy, and aluminum (Al) or its alloy.

Furthermore, when the surface layer comprising a noble metal or its alloy is formed with a plating method in order to prevent diffusion and improve adhesiveness of the surface layer comprising a base material constituent and a noble metal or its alloy, an underlying layer may be provided according to the circumstances, such as Ni and its alloy, or cobalt (Co) and its alloy, or Cu and its alloy, etc. The underlying layer may be comprised of a plurality of layers, and it is preferable to provide various kinds of underlying structures according to a specification and a purpose of the coating, etc. There is no limitation to a thickness of the layers. Considering a utilization condition as the material for an electrical contact and cost, etc., the thickness of the surface layer comprised of a noble metal or an alloy that has a noble metal as a major constituent is preferably 0.01-10 μm, and more preferably, 0.1-2 μm, including the underlying layer.

The organic film formed on the surface layer comprised of a noble metal or its alloy is an organic film having heat resistance is formed of an organic compound having an ether bonding group. In this context, "having heat resistance" means to have a property in which a coefficient of kinetic friction after 100 times of sliding at an ambient temperature 80° C. is less than or equal to 0.4, and a value of a rating number specified in JIS (Japanese Industrial Standards) H 8502 at an ambient temperature 80° C. is greater than or equal to 6.

The organic film has an ether bonding group that absorbs the noble metal physically or chemically and also has a lubricating property, and is a film having heat resistance for improving corrosion resistance and lubricating property.

As for the present invention, there is no limitation to a thickness of the organic film, and in view of suppressing contact resistance, it is preferably 0.0001-0.1 μm, and more preferably 0.0001-0.01 μm.

Examples for the organic compound having the ether bonding group include an ether compound having 5-40 carbon atoms, and preferably an ether compound having 6-30 carbon atoms. Furthermore, as the organic compound having the ether bonding group, an ether compound having at least one unsaturated bonding is more preferable. An ether compound having the number of carbon atoms in the range forms an organic film having good heat resistance, corrosion resistance, and sliding property.

Specific examples of the ether compound include dipropyl ether, allylphenyl ether, ethylisobutyl ether, ethylene glycol diphenyl ether, pentaphenyl ether, alkyl (e.g., nonyl, eicocyl), and diphenyl ether. In particular, ether compounds with a molecular weight of 100 or more (preferably, 600 or less) have relatively high boiling temperature, and produce organic films having good heat resistance, and provide advantageous effects. Furthermore, when a hydrocarbon group that consists of an ether compound is an unsaturated hydrocarbon, the heat resistance tends to be higher compared with saturated hydrocarbons with the same number of carbon atoms, and therefore, more preferable.

With regards to the method of forming the organic film, it is preferable to use a method of immersing a material that has a surface layer comprised of a noble metal or an alloy that has a noble metal as a major constituent into a solution containing the organic compound and drying it. Alternatively, it may be formed by drying after passing through into a solution mist that contains the organic compound, or wiping with cloths, etc., made wet with the solution.

A concentration of the organic compound having the ether bonding group such as an ether compound in the solution is not limited. Preferably, the organic compound may be dissolved in an appropriate solvent such as toluene, acetone, trichloroethane, commercially available synthetic solvent (e.g., NS Clean 100; Japan Energy Corporation made), etc., so that the concentration thereof becomes 0.01-10 mass %. There is no limitation to the processing temperature and the processing time for forming the organic film, and a suitable organic film can be formed by immersing for 0.1 sec or more (preferably, 0.5-10 sec.) at a normal temperature (25° C.)

In the organic film processing, a formation processing of an organic film may be performed two times or more. Alternatively, the formation processing of the organic film using mixture liquid comprised of two kinds or more of ether compounds may be performed two times or more. Or, the processes may be performed one by one alternately for the formation processing. It is preferable to perform the formation processing three times or less considering the number of steps and costs.

In the following, a further embodiment of the electrical contact material according to the present invention will be described referring to FIG. 3.

Figure 3:
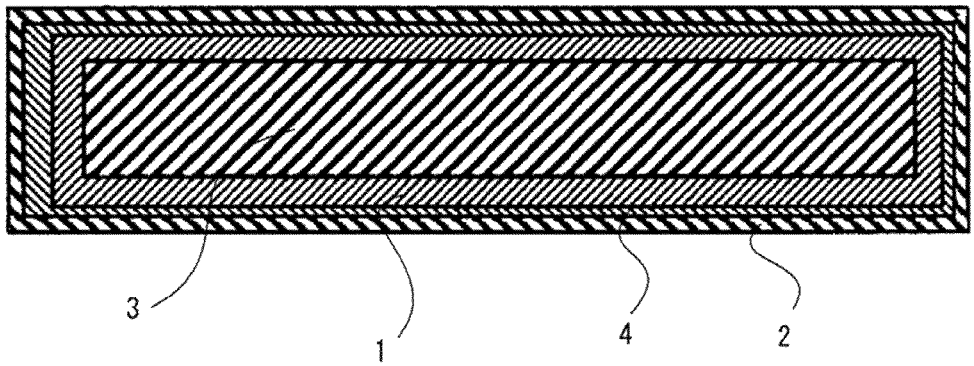
FIG. 3 is a cross sectional view of an electrical contact material according to a further embodiment of the present invention.

FIG. 3 shows a cross sectional view of an electrical contact material according to the further embodiment of the present invention. In FIG. 3, a surface layer comprising a noble metal or its alloy 1 is provided on the surface of the base material 3. A first organic film layer 4 comprised of either one or a mixture of aliphatic amine and mercaptan is provided on the surface of the surface layer. A second organic film 2 having heat resistance formed with an organic compound having an ether bonding group is provided on the surface of the first organic film layer 4.

The organic film formed on a surface of the surface layer comprised of a noble metal or its alloy is provided with the first organic film layer comprised of either one or a mixture of an aliphatic amine and a mercaptan, and is provided with the second organic film having heat resistance formed with an organic compound having an ether bonding group on the surface of the first organic film layer. Accordingly, lubricating property and corrosion resistance improve. Specifically, the first organic film layer comprised of either one or a mixture of an aliphatic amine and a mercaptan is provided for improving corrosion resistance mainly by applying a film formation processing using aliphatic amine and/or a mercaptan which are easily adsorbed to noble metals. As the aliphatic amine and mercaptan used for the present invention, an aliphatic amine and a mercaptan having 5-50 carbon atoms are preferable. Examples include dodecyl amine, icosyl amine, nonyl amine, dodecyl mercaptan, octadecyl mercaptan, icosyl mercaptan, and nonyl mercaptan. The first organic film formed with an aliphatic amine or a mercaptan having the number of carbon atoms in the above-described range does not adversely affect heat resistance of the second organic film, which is formed thereafter.

As for the method of film formation processing, it is preferable to immerse a material having a surface layer comprised of a noble metal or an alloy that has a noble metal as a major constituent into a solution containing an aliphatic amine and a mercaptan. Alternatively, passing through into a solution mist containing the aliphatic amine, etc., or wiping with cloth, etc., made wet with the solution, may be adopted.

A concentration of the aliphatic amine or the mercaptan in the solution is not limited. Preferably, they are resolved into an appropriate solvent such as toluene, acetone, trichloroethane, and commercial available synthetic solvent, so as to have a concentration of 0.01-10 mass %.

A processing period is not limited, and a suitable organic film may be formed by immersing 0.1 sec. or more (preferably, 0.5-10 sec.) at a normal temperature.

The formation processing of the organic film may be performed two times or more. Alternatively, the formation processing of the organic film may be done two times more using a mixture liquid containing one kind or more of an aliphatic amine and/or a mercaptan. Or, the formation processing may be performed one by one. It is preferable to perform the formation processing three times or less considering the steps and cost.

After forming the first organic film, the second organic film having heat resistance comprised of the organic compound containing the ether bonding group is formed on the surface of the first organic film layer. In addition to the effects, the second organic film is provided for protecting the first organic film from sliding that cannot be tolerated when used as a sliding contact in a relatively high load. Further, there is an advantageous effect of protecting the first organic film layer with corrosion resistance for a long time period, and is a film having a good heat resistance. A method for processing the surface can be achieved by a film formation processing, which is a similar method as described above, after the first organic film layer comprised of either one or a mixture of the aliphatic amine and the mercaptan is formed.

In the present invention, there is no limitation to a thickness of the first and second organic film, and it is preferably, 0.0001-0.1 μm, and more preferably, 0.0001-0.01 μm, in view of suppressing contact resistance.

With regards to the processes, the processing for only the organic film comprised of the organic compound having the ether bonding group, and the processing that forms the organic film from the organic compound having the ether bonding group after processing and the organic film comprised of either one or a mixture of the aliphatic amine and the mercaptan, have advantageous effects for all of the noble metals and their alloy. The above-described processes have advantageous effects especially with Au, Ag, Cu, Pt, Pd, or an alloy which has one or more as a major constituent. With respect to the processing, they have advantageous effects especially with Ag, or alloys which has Ag as a major constituent.

Furthermore, the condition of the outermost layer before the organic film is formed is active. Accordingly, when a surface layer comprising the noble metals or their alloy is formed by a plating method or a cladding method, the organic film adsorbs more, and advantageous effects of corrosion resistance and lubricating property can be expected. The electrical contact using the electrical contact material of the present invention formed with the methods has improved heat resistance and corrosion resistance compared to a conventional contact materials, and can form an electrical contact having a superior abrasion resistance.

Examples of the electrical contact of the present invention include electrical contacts that involve repeated insertions and extractions and sliding, and more specifically, connector terminals and sliding switches for harnesses of automobiles, contact switches equipped in mobile phones, and terminals of memory cards and PC cards. These are essentially for use with electrical signals or small electrical currents, and the condition of the organic film will not be changed by sparks, etc., upon switching on and off of the switches or connecting the terminals. Moreover, since the electrical contact of the present invention forms an organic film having heat resistance, it can be suitably used under high temperature environments.

The electrical contact material of the present invention is excellent in a corrosion resistance and sliding property, and has a long duration life. The electrical contact material of the present invention is excellent in the sliding property and has a corrosion resistance by having an abrasion resistance even in relatively high load environments with about 1N or more. In accordance with a manufacturing method of the present invention, it achieves an electrical contact material having a greater corrosion resistance and lubricating property and having an excellent sliding property.

The electrical contact of the present invention has a long duration of life due to the excellent heat resistance, corrosion resistance, and polishing property, and is suitable for sliding switches, tactile switches, etc., that involves sliding.

In the following, the present invention will be described in detail based on the embodiments, but the present invention is not limited to those.

Embodiment Samples

Embodiment 1

After performing a pre-processing of an electrolysis degreasing and acid washing of a C14410 strip of thickness 0.3 mm and width 180 mm (base material), a plating constructed material having a plating thickness 0.5 μm shown in Table 1 was manufactured. Then, an organic film formation processing was applied to the obtained plating constructed material, and electrical contact materials of the present invention (Embodiment samples 1-14) and Comparison samples 1-8 of an organic film thickness 0.01 μm was obtained. Furthermore, as a prior art sample, a plating of Ag-5% Sb alloy was applied on the above base material and an electrical contact material of Prior art sample 1 was obtained.

In order to determine the corrosion resistance for the above-described electrical contact material, a sulfuration experiment was performed. The results are expressed in numbers with rating numbers (hereafter referred to "RN") for evaluation. The RN uses the Standard Figures and Tables described in JIS H 8502 as the determination standard, and it indicates that the larger the number is, the better the corrosion resistance is. Furthermore, in order to obtain the sliding property, a measurement for the coefficient of kinetic friction for the portion that is used as the sliding electrical contact was performed, and the coefficient of kinetic friction after 100 times of sliding are described in Table 1 together with the result of the above described sulfuration experiment.

The pre-processing condition and the plating condition will be described in the following.

(Pre-Processing Condition)

[Electrolysis Degreasing]

Degreasing liquid: NaOH 60 g/l

Degreasing condition: 2.5 A/dm$^2$, temperature 60° C., and degreasing period 60 sec.

[Acid Washing]

Acid washing liquid: 10% sulfuric acid

Acid washing condition: 30 sec. immersion, and normal temperature (25° C.)

(Plating Condition)

[Au Plating]

Plating solution: KAu(CN)2 14.6 g/l, $C_6H_8O_7$ 150 g/l, and $K_2C_6H_4O_7$ 180 g/l Plating condition: current density 1 A/dm2, and temperature 40° C.

[Au—Co Plating]

Plating solution: $KAu(CN)_2$ 14.6 g/l, $C_6H_3O_7$ 150 g/l, $K_2C_6H_4O_7$ 180 g/l, EDTA-Co(II) 3 g/l, and piperazine 2 g/l Plating condition: current density 1 A/dm$^2$, and temperature 40° C.

[Ag Plating]

Plating solution: AgCN 50 g/l, KCN 100 g/l, and $K_2CO_3$ 30 g/l

Plating condition: current density 0.5-3 A/dm$^2$, and temperature 30° C.

[Cu Plating]

Plating solution: $CuSO_4.5H_2O$ 250 g/l, $H_2SO_4$ 50 g/l, and NaCl 0.1 g/l

Plating condition: current density 6 A/dm$^2$, and temperature 40° C.

[Pd Plating]

Plating solution: $Pd(NH_3)_2Cl_2$ 45 g/l, $NH_4OH$ 90 ml/l, and $(NH_4)_2SO_4$ 50 g/l Plating condition: current density 1 A/dm2, and temperature 30° C.

[Pd—Ni Alloy Plating: Pd/Ni(%) 80/20]

Plating solution: $Pd(NH_3)_2Cl_2$ 40 g/l, $NiSO_4$ 45 g/l, $NH_4OH$ 90 ml/l, and $(NH_4)_2SO_4$ 50 g/l Plating condition: current density 1 A/dm2, and temperature 30° C.

[Ru Plating]

Plating solution: $RuNOCl_3.5H_2O$ 10 g/l, and $NH_2SO_3H$ 15 g/l

Plating condition: current density 1 A/dm2, and temperature 50° C.

[Pt Plating]

Plating solution: $Pt(NO_2)_2(NH_3)_2$ 10 g/l, $NaNO_2$ 10 g/l, $NH_4NO_3$ 100 g/l, and $NH_3$ 50 ml/l Plating condition: current density 5 A/dm$^2$, and temperature 90° C.

The film formation processing condition will be described in the following.

Immersion solution: 0.5 mass % ether compound solution (solvent toluene)

Immersion condition: normal temperature 5 sec. immersion

Desiccation: 40° C. 30 sec.

Furthermore, the sulfuration experiment condition and coefficient of kinetic friction measurement condition will be described in the following.

[Sulfuration Experiment]

Sulfuration experiment condition: $H_2S$ 3 ppm, 40° C., 48 hours, and 80% Rh

[Measurement of Coefficient of Kinetic Friction]

Measurement condition: Steel sphere probe having R (radius) =3.0 mm, sliding distance 10 mm, sliding speed 100 mm/sec., sliding times: 100 times round trip, load 1N, 65% Rh, and 25° C.

TABLE 1

Details of Embodiment sample, Comparison sample and Prior art sample and their results

| | Outermost layer | Organic film | RN | Coefficient of kinetic friction |
|---|---|---|---|---|
| Embodiment sample 1 | pure Au | pentaphenyl ether | 9.3 | 0.35 |
| Embodiment sample 2 | Au—0.3% Co | pentaphenyl ether | 9.5 | 0.3 |
| Embodiment sample 3 | pure Ag | pentaphenyl ether | 7 | 0.3 |
| Embodiment sample 4 | pure Ag | dipropyl ether | 7 | 0.3 |
| Embodiment sample 5 | pure Ag | allylphenyl ether | 7 | 0.3 |
| Embodiment sample 6 | pure Ag | ethylisobutyl ether | 7 | 0.3 |
| Embodiment sample 7 | pure Ag | ethylene glycol diphenyl ether | 7 | 0.3 |

TABLE 1-continued

Details of Embodiment sample, Comparison sample and Prior art sample and their results

| | Outermost layer | Organic film | RN | Coefficient of kinetic friction |
|---|---|---|---|---|
| Embodiment sample 8 | pure Ag | alkyldiphenyl ether | 7 | 0.3 |
| Embodiment sample 9 | pure Ag | tetraphenyl ether | 7 | 0.3 |
| Embodiment sample 10 | pure Cu | pentaphenyl ether | 8 | 0.35 |
| Embodiment sample 11 | pure Pt | pentaphenyl ether | 9.5 | 0.35 |
| Embodiment sample 12 | pure Pd | pentaphenyl ether | 9.5 | 0.35 |
| Embodiment sample 13 | Pd—20% Ni | pentaphenyl ether | 9.5 | 0.35 |
| Embodiment sample 14 | pure Ru | pentaphenyl ether | 9 | 0.3 |
| Comparison sample 1 | pure Au | none | 9 | 0.8 |
| Comparison sample 2 | Au—0.3% Co | none | 9 | 0.8 |
| Comparison sample 3 | pure Ag | none | 3 | 1 |
| Comparison sample 4 | pure Cu | none | 5 | 1 |
| Comparison sample 5 | pure Pt | none | 9 | 0.9 |
| Comparison sample 6 | pure Pd | none | 9 | 0.9 |
| Comparison sample 7 | Pd—20% Ni | none | 9 | 0.9 |
| Comparison sample 8 | pure Ru | none | 8 | 0.8 |
| Prior art sample 1 | Ag—5% Sb | nonyl mercaptan | 7 | 1 |

In Table 1, "Outermost layer" indicates a surface layer in which a noble metal or an alloy having a noble metal as a major constituent is exposed before forming the organic film. This is the same with Table 2.

As is apparent from Table 1, the corrosion resistance and sliding property are greatly improved by providing an organic film formed with an organic compound having an ether bonding group at the surface of the noble metal or its alloy. Furthermore, in Prior art sample 1, it is apparent that the result shows an undesirable increase in the coefficient of kinetic friction when the load became 1N.

A similar experiment was performed by increasing the ambient temperature up to 80° C., but the characteristics of each of the embodiments were nearly the same with the result at an ambient temperature 25° C. shown in Table 1. In particular, the ether compounds in embodiments other than Embodiment sample 4 and Embodiment sample 6 include an unsaturated hydrocarbon group, and the change in the characteristics when the ambient temperature was increased tends to be small, and therefore, the heat resistance improved. In contrast, with respect to samples of each of the Comparison samples and Prior art sample 1, as a result of performing similar experiment by increasing the ambient temperature up to 80° C., the coefficient of kinetic friction for all of them exceeded 1 and the RN values for all of them were 5 or less.

Embodiment 2

After performing a pre-processing of an electrolysis degreasing and acid washing of a C14410 strip of thickness 0.3 mm and width 180 mm (base material), a plating constructed material having a plating thickness 0.5 μm shown in Table 2 was manufactured. Then, an organic film formation processing was applied to the obtained plating constructed material, and electrical contact materials of the present invention having a first organic film thickness 0.01 μm and second organic film thickness 0.01 μm (Embodiment samples 15-28) were obtained. As for electrical contact materials of Comparison sample 1-8 and Prior art sample 1, they are similar to the above described materials.

The conditions for the film formation processing will be described in the following.

(Formation of First Organic Film)

Immersion solution: 0.2 mass % aliphatic acid amine or mercaptan solution (solvent toluene)

Immersion condition: normal temperature 5 sec. immersion

Desiccation: 40° C., and 30 sec.

(Formation of Second Organic Film)

Immersion solution: 1.0 mass % ether compound solution (solvent: NS Clean 100)

Immersion condition: normal temperature 5 sec. immersion

Desiccation: 40° C., and 30 sec.

In order to determine the corrosion resistance for the above-described electrical contact material, a sulfuration experiment was performed. The numbers for result were determined with RN as in Embodiment sample 1 for the evaluation. Furthermore, in order to obtain the sliding property, the coefficient of kinetic friction was measured for the portion for use as a sliding electrical contact, and the coefficient of kinetic friction after 100 times of sliding was described in Table 2 together with the result of the above-described sulfuration experiment. The pre-processing condition, plating condition, sulfuration experiment condition, and the coefficient of kinetic friction measurement were performed with a similar condition with Embodiment sample 1.

TABLE 2

Details of Embodiment samples and Comparison samples and their results

| | Outermost layer | Organic film | | RN | Coefficient of kinetic friction |
|---|---|---|---|---|---|
| Embodiment sample 15 | pure Au | octadecyl mercaptan | pentaphenyl ether | 9.8 | 0.3 |
| Embodiment sample 16 | Au—0.3% Co | octadecyl mercaptan | pentaphenyl ether | 9.8 | 0.25 |
| Embodiment sample 17 | pure Ag | octadecyl mercaptan | pentaphenyl ether | 9 | 0.25 |
| Embodiment sample 18 | pure Ag | dodecyl amine | pentaphenyl ether | 9 | 0.25 |
| Embodiment sample 19 | pure Ag | icosyl amine | pentaphenyl ether | 9 | 0.25 |
| Embodiment sample 20 | pure Ag | nonyl amine | pentaphenyl ether | 9 | 0.25 |

TABLE 2-continued

| Details of Embodiment samples and Comparison samples and their results | | | | | |
|---|---|---|---|---|---|
| | Outermost layer | Organic film | | RN | Coefficient of kinetic friction |
| Embodiment sample 21 | pure Ag | dodecyl mercaptan | pentaphenyl ether | 9 | 0.25 |
| Embodiment sample 22 | pure Ag | icosyl mercaptan | pentaphenyl ether | 9 | 0.25 |
| Embodiment sample 23 | pure Ag | nonyl mercaptan | pentaphenyl ether | 9 | 0.25 |
| Embodiment sample 24 | pure Cu | octadecyl mercaptan | pentaphenyl ether | 9 | 0.3 |
| Embodiment sample 25 | pure Pt | octadecyl mercaptan | pentaphenyl ether | 9.8 | 0.3 |
| Embodiment sample 26 | pure Pd | octadecyl mercaptan | pentaphenyl ether | 9.8 | 0.3 |
| Embodiment sample 27 | Pd—20% Ni | octadecyl mercaptan | pentaphenyl ether | 9.8 | 0.3 |
| Embodiment sample 28 | pure Ru | octadecyl mercaptan | pentaphenyl ether | 9.5 | 0.25 |
| Comparison sample 1 | pure Au | none | none | 9 | 0.8 |
| Comparison sample 2 | Au—0.3% Co | none | none | 9 | 0.8 |
| Comparison sample 3 | pure Ag | none | none | 3 | 1 |
| Comparison sample 4 | pure Cu | none | none | 5 | 1 |
| Comparison sample 5 | pure Pt | none | none | 9 | 0.9 |
| Comparison sample 6 | pure Pd | none | none | 9 | 0.9 |
| Comparison sample 7 | Pd—20% Ni | none | none | 9 | 0.9 |
| Comparison sample 8 | pure Ru | none | none | 8 | 0.8 |
| Prior art sample 1 | Ag—5% Sb | nonyl mercaptan | none | 7 | 1 |

As is apparent from Table 2, Embodiment samples 15-28, which is provided with an organic film layer comprised of either one or a mixture of aliphatic amine and mercaptan on the surface of a noble metal or its alloy, and providing an organic film that is formed with an organic compound having an ether bonding group on an upper layer, have a further improved corrosion resistance and sliding property compared with Embodiment sample 1-14 in which only the organic film that is formed with an organic compound having an ether bonding group described in Table 1. Especially, with respect to Ag, it shows that not only the coefficient of kinetic friction but also the corrosion resistance is further largely improved.

A similar experiment was performed by increasing the ambient temperature up to 80° C., but the characteristics of each of the embodiment samples were nearly the same with the result at ambient temperature 25° C. shown in Table 2. In contrast, with respect to the samples of each of the Comparison samples and Prior art sample 1, when the ambient temperature was increased to 80?C, the coefficients of kinetic friction for all of them exceeded 1 and the RN values for all of them became 5 or less.

In the above-described Embodiment samples, only an example in which the thickness of the organic film formed with an organic compound having an ether bonding group is 0.01 ?m was exemplified, but actually, if the thickness of the organic film formed with an organic compound having an ether bonding group is within a range of 0.0001 μm-0.1 μm, a nearly similar result can be obtained for the heat resistance, corrosion resistance and sliding property.

INDUSTRIAL APPLICABILITY

The electrical contact material of the present invention is suitably used for a long duration of life especially in an electrical contact for sliding switch, tactile switch, etc., that involves sliding.

Although the present invention was described with the embodiments, unless otherwise described, it was not intended to limit the invention in any of the details, and the invention is to be construed broadly within the spirit and the scope of the invention.

The application claims priority of a Japanese patent application serial No. 2007-005203 filed on Jan. 12, 2007 and a Japanese patent application serial No. 2008-003755 filed on Jan. 10, 2008, the entire content of which is incorporated herein by the reference as a part of the specification.

The invention claimed is:

1. An electrical contact material, comprising:

a surface layer formed of a noble metal or an alloy containing the noble metal as a major constituent;

a first organic film layer on a surface of the surface layer, said first organic film being formed of an aliphatic amine, a mercaptan, or a mixture thereof; and a second organic film having heat resistance on a surface of the first organic film layer, said second organic film being formed of an ether compound having an ether bonding group and a hydrocarbon group, and having carbon atoms between 5 and 40, so that the electrical contact material has good corrosion resistance and sliding property.

2. The electrical contact material according to claim 1, wherein said noble metal forming the surface layer includes at least one of Au, Ag, Cu, Pt, Pd, and an alloy containing at least one of these as a major constituent.

3. The electrical contact material according to claim 1, wherein said noble metal forming the surface layer includes Ag or an alloy containing Ag as a major constituent.

4. A method of manufacturing the electrical contact material according to claim 1, wherein said surface layer formed of the noble metal or the alloy containing the noble metal as the major constituent is formed with a plating method or a cladding method.

5. An electrical contact formed of the electrical contact material according to claim 1.

6. The electrical contact material according to claim 1, wherein said hydrocarbon group is an unsaturated hydrocarbon group.

7. The electrical contact material according to claim 1, which has abrasion resistance under a load of 1N or more.

* * * * *